United States Patent [19]

Hamburg et al.

[11] Patent Number: 5,074,261

[45] Date of Patent: Dec. 24, 1991

[54] ROCKER ARM ASSEMBLY

[75] Inventors: Michael G. Hamburg, Farmington; Richard F. Murphy; Gordon L. Steltzer, both of Torrington, all of Conn.

[73] Assignee: The Torrington Company, Torrington, Conn.

[21] Appl. No.: 640,928

[22] Filed: Jan. 14, 1991

[51] Int. Cl.[5] ..... F01L 1/18

[52] U.S. Cl. ..... 123/90.39; 123/90.41; 74/519; 74/559

[58] Field of Search ..... 123/90.39, 90.41, 90.42; 74/519, 559

[56] References Cited

U.S. PATENT DOCUMENTS

| | | | |
|---|---|---|---|
| 3,251,350 | 5/1966 | Thompson | 74/519 |
| 3,466,073 | 9/1969 | Pohle | 123/90.39 |
| 3,621,823 | 11/1971 | Lombardi | 74/519 |
| 4,314,732 | 2/1982 | Murphy | 123/90.41 |
| 4,697,473 | 10/1987 | Patel | 123/90.39 |
| 4,718,379 | 1/1988 | Clark | 123/90.39 |
| 4,727,832 | 3/1988 | Miyamura et al. | 123/90.39 |
| 4,858,575 | 8/1989 | Fittro et al. | 123/90.41 |
| 4,896,635 | 1/1990 | Willer et al. | 123/90.41 |
| 4,944,257 | 7/1990 | Mills | 123/90.39 |
| 4,967,705 | 11/1990 | Magiag et al. | 123/90.48 |

*Primary Examiner*—E. Rollins Cross
*Assistant Examiner*—Weilun Lo
*Attorney, Agent, or Firm*—John C. Bigler

[57] ABSTRACT

A bearing support member and bearings form a subassembly that can be inserted, in the direction of the axis of the bearings, into a bore of a rocker arm. A support stud can then be passed through an aperture in the rocker arm and a bore in the bearing support member so as to engage the rocker arm and maintain alignment of the rocker arm and bearings. Also disclosed are an inner sleeve and particular configuration of the bearing support member to facilitate manufacture of the bearing support member by powdered metal forming.

15 Claims, 2 Drawing Sheets

FIG. 3
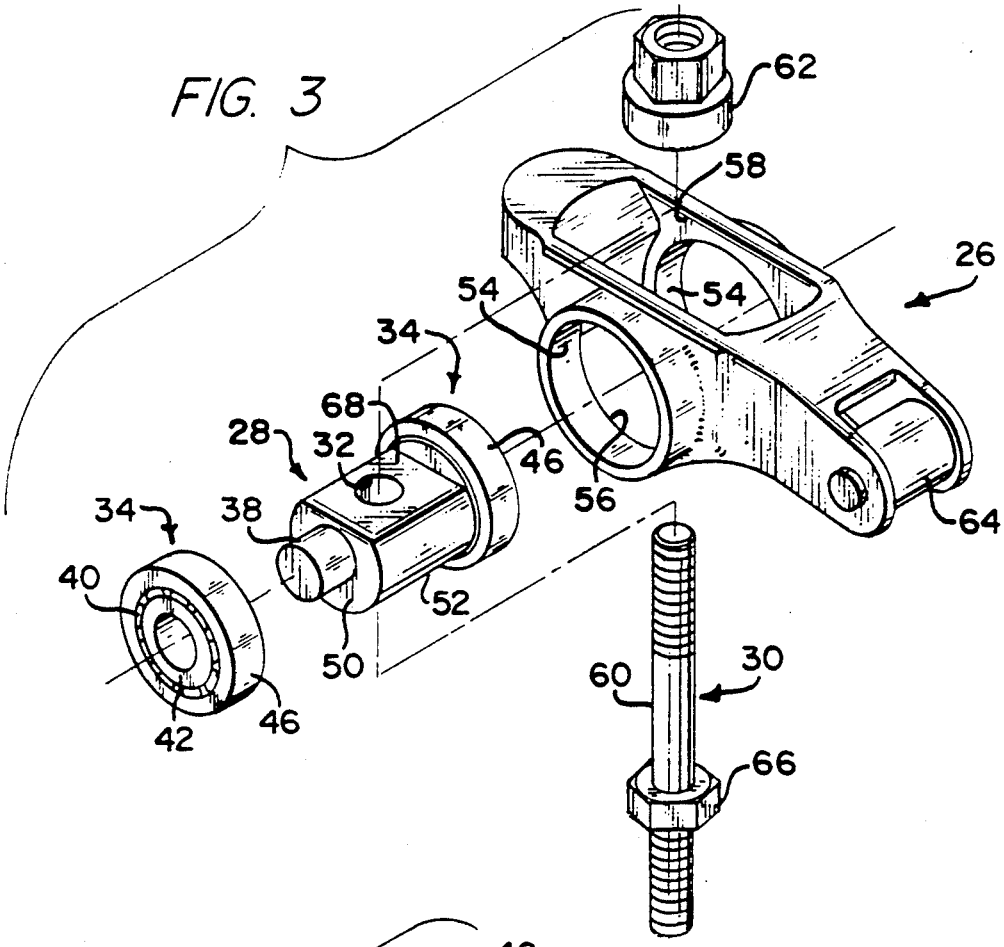
FIG. 4
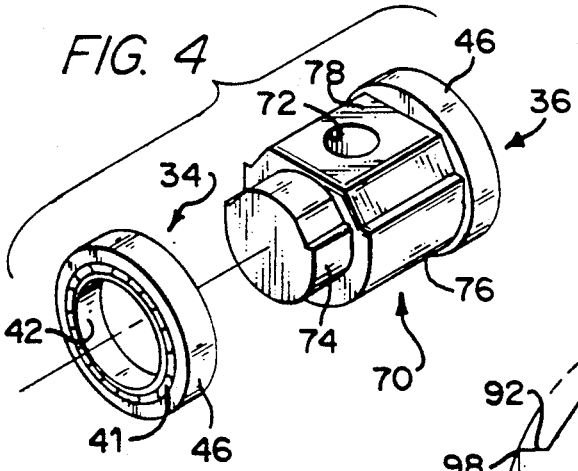
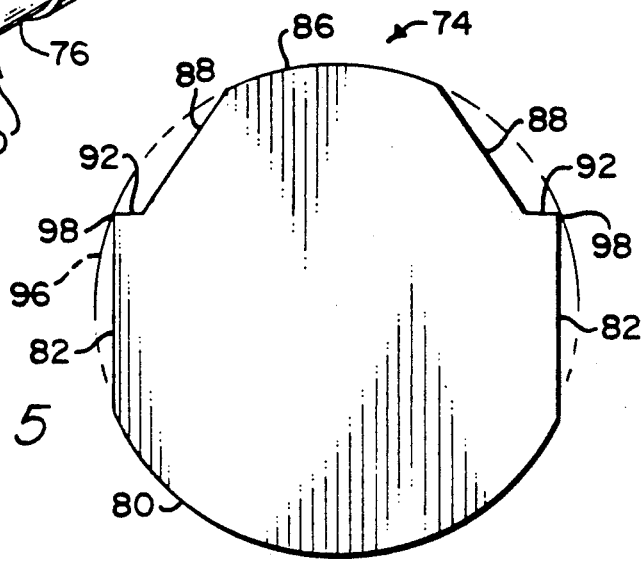
FIG. 5

ROCKER ARM ASSEMBLY

BACKGROUND OF THE INVENTION

This invention relates generally to valve operating mechanisms for use in internal combustion engines, and more particularly to an oscillating rocker arm assembly having anti-friction bearings.

Conventional valve train rocker arms of internal combustion engines use various bearing means to accommodate loads. In addition to the loads generated by the rocker arms pushing the valves against the force of the valve springs, loads are generated by the oscillating motion of the rocker arms themselves. In order to achieve increased fuel efficiency and performance of internal combustion engines, anti-friction bearings with rollers have been used to support the rocker arms in place of plain bearings.

Typically, a rocker arm assembly with anti-friction bearings has a support shaft for supporting the rocker arm. The support shaft is mounted perpendicularly from a support stud extending from the head of the engine. The rocker arm is pivoted on the support shaft, which serves as an inner raceway, by means of drawn cup needle roller bearings mounted on the rocker arm. Retaining rings on the ends of the support shaft engage the cups of the bearings and limit axial movement of the support shaft relative to the rocker arm.

Such a rocker arm assembly is expensive and difficult to manufacture. The support shaft is first machined and hardened. The rocker arm is positioned over the support shaft before the bearings are mounted on the support shaft. The cups of the bearings are then press-fit into the rocker arm from opposite sides. Finally, retaining rings are mounted on the ends of the support shaft to limit axial movement of the bearings.

Much of the expense of such rocker arm assemblies is due to the need for drawn cup needle roller bearings having rollers with trunnions and the need for a machined and hardened support shaft. Additional expense is due to the numerous steps required at final assembly to the engine block. Although present rocker arm assemblies achieve increased fuel efficiency and performance, the costs associated with those assemblies have made them impractical for many applications.

The foregoing illustrates limitations known to exist in present rocker arm assemblies. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a rocker arm assembly having a bearing support member adapted for mounting on a support stud. Two annular bearings, having a common axis, are supported and retained on the bearing support member, the circumference of the bearings defining a cylindrical envelope perpendicular to the support stud and enclosing the bearing support member. A rocker arm, having a bore at least as large as the diameter of the cylindrical envelope and having an aperture for receiving the support stud, receives the bearings in the bore such that the rocker arm may be pivoted on the bearings relative to the axis of the bearing support member. Retaining means on the rocker arm is engageable with the support stud for limiting movement of the rocker arm away from the support stud and for limiting axial movement of the rocker arm relative to the bearings.

The foregoing and other aspects will become apparent from the following detailed description of the invention when considered in conjunction with the accompanying drawing figures.

BRIEF DESCRIPTION OF THE DRAWING FIGURES

FIG. 3 is an exploded view of the rocker arm assembly of FIG. 1;

FIG. 4 is an enlarged exploded view of a portion of a second embodiment of the rocker arm assembly of the present invention; and FIG. 5 is an enlarged end view of the bearing support member of the rocker arm assembly of FIG. 4.

DETAILED DESCRIPTION

Figure 1:
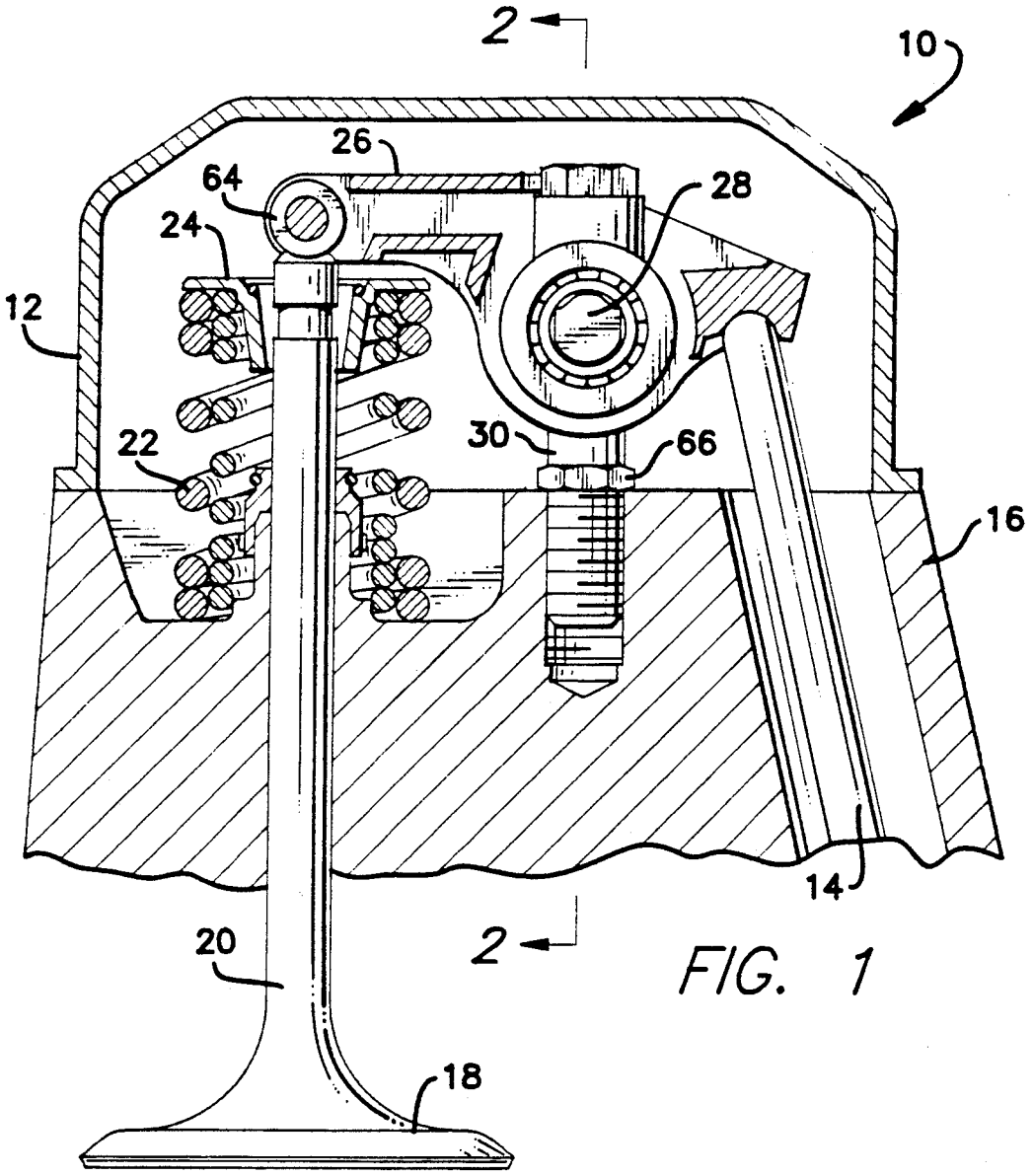
FIG. 1 is a side view, partially in section, showing a portion of an internal combustion engine illustrating an embodiment of the rocker arm assembly of the present invention.

Referring now to the drawings, FIG. 1 illustrates a portion of an internal combustion engine 10 and the relative positions of a valve cover 12, push rod 14, cylinder head 16, poppet valve 18, valve stem 20, valve spring 22, and valve spring retainer 24. Those engine parts are conventional and are illustrated to show the environment of the present invention.

Figure 2:
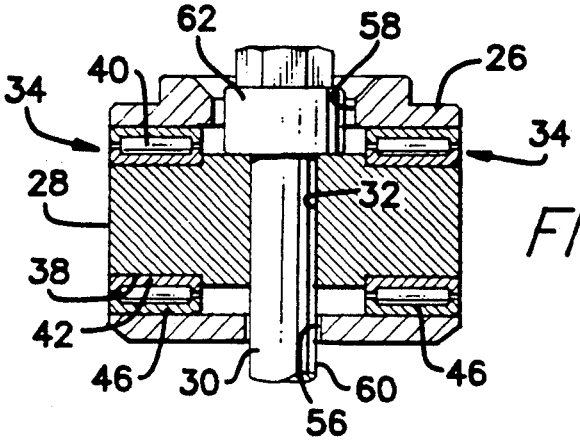
FIG. 2 is an enlarged partial sectional view of the rocker arm assembly, taken along line 2—2 of FIG. 1.

A rocker arm 26 is supported on bearing support member 28 to form the rocker arm assembly of the present invention. As illustrated in FIGS. 2 and 3, the bearing support member 28 has a substantially vertical bore 32 slightly larger than the diameter of a support stud 30 to allow insertion of the support stud 30. Two annular roller bearings 34 are mounted on cylindrical end portions 38 of the bearing support member 28. The roller bearings 34 have cylindrical rollers 40 between inner sleeves 42 and outer sleeves 46.

The inner sleeves 42 are press-fit or staked to the end portions 38 and have radially outwardly extending flanges that are axially outward of the rollers 40 to prevent outward movement of the bearings 34. The outer sleeves 46 have radially inwardly extending flanges that are axially inward of the rollers 40. The bearing support member 28 has shoulders 50 extending radially outward from the end portions 38 to prevent the inward motion of the bearings 34 by engagement with the outer sleeves 46.

Both the inner sleeves 42 and the outer sleeves 46 may be drawn and hardened to form bearing quality raceways. The forming procedure is economical and is similar to the forming of cups for drawn cup roller bearings. The rollers 40 are cylindrical. Significantly, the bearings 34 do not require expensive journaled rollers.

Between the end portions 38 of the bearing support member 28 is a substantially cylindrical central portion 52 joining the shoulders 50. The shoulders 50 and the central portion 52 are dimensioned such that they do not extend radially outward beyond a cylindrical envelope defined by the circumferences of the bearings 34. Thus, the bearing support member 28 and the bearings 34 form a subassembly that is substantially cylindrical in its outer dimensions, having a maximum diameter equal to that of the bearings 34.

The rocker arm 26 is formed with a substantially horizontal bore 54 extending therethrough, perpendicularly relative to the support stud 30. The diameter of the bore 54 is at least as large as the diameter of the bearings 34 to permit the subassembly of the bearing support member 28 and bearings 34 to be inserted axially into the bore 54. Preferably, the bore 54 is somewhat larger to facilitate insertion and to provide a loose fit between the rocker arm 26 and the bearings 34. No press-fit of the bearings 34 in the bearing support member 28 is required, because other means are provided to limit axial movement of the bearing support member 28 relative to the rocker arm 26.

An elongated lower aperture 56 and an elongated upper aperture 58 are formed in the rocker arm 26 to accommodate the support stud 30. As shown in FIG. 2, the width of the aperture 56 is slightly greater than the diameter of a shank portion 60 of the support stud 30 to engage the surface of the shank portion 60 to limit axial movement of the bearing support member 28 relative to the rocker arm 26. Alternatively, the support stud 30 may include a skirt portion 62 engageable with the aperture 58 to serve as the alignment means, or both the shank portion 60 and the skirt portion 62 surfaces of the support stud 30 may be used.

The apertures 56 and 58 are elongated to provide clearance for the support stud 30 in order to allow the rocker arm 26 to rock or rotate about the axis of the bearing support member 28. The particular configuration of the rocker arm 26 is dependent on the method of forming used. FIGS. 1 through 3 indicate a shape appropriate for casting. Variations in the configuration to facilitate forming by forging, stamping and powdered metal forming will be apparent to those skilled in the art.

The rocker arm 26 may include a roller 64, as shown in FIGS. 1 and 3, for engaging the valve stem 20 or have a conventional sliding engagement. As shown in those same figures, the support stud 30 may include wrench surfaces 66 to facilitate threading the support stud 30 into the engine block 16. Preferably, the upper surface of the central portion 52 of bearing support member 28 has a recess or flat 68 for receiving the skirt portion 62, thereby reducing the overall height of the rocker arm assembly and facilitating alignment of the skirt portion 62 with the upper aperture 58.

FIG. 4 illustrates a second embodiment of the present invention having a bearing support member 70 similar to bearing support member 28 of the first embodiment. Bearing support member 70 has a modified configuration to facilitate its manufacture by powdered metal forming. A substantially vertical bore 72, end portions 74, a central portion 76, and a flat 78, correspond to the bore 32, end portions 38, central portion 52, and flat 68 of the first embodiment.

As illustrated in FIG. 5, the configuration of the end portions 74, in cross-section, includes an arcuate bottom portion 80 extending less than 180 degrees, parallel flat side portions 82, and an arcuate top portion 86. Tooling reliefs formed by angled portions 88 and flat portions 92 extend inward from a circle 96 indicating an ideal trunnion configuration for the end portions 74. The arcuate length of the top portion 86 is shorter than that of the bottom portion 80 due to the tooling reliefs.

The angled portions 88 are aligned at approximately 45 degrees relative to the axis of the bore 72, and the flat side portions 82 are aligned parallel to the axis of the bore 72. This alignment simplifies the tooling for making the bearing support member 70 when powdered metal forming dies moving in the direction of the axis of the bore 72 are used.

Preferably, the arcuate bottom and top portions 80 and 86 coincide with the circle 96. The side portions 82 intersect the bottom portion 80 and the flat portions 92 at corners 98 on the circle 96, and the arcuate top portion 86 also intersects the angled portions 88 on the circle 96. The central portion 76 of the modified bearing support member 70 is configured similarly as the end portions 74, as illustrated in FIG. 5, but may have a flat 78 in place of the arcuate top portion 86.

Because of this modified configuration of bearing support member 70, metal forming dies with durable contours may be used. In contrast, powdered metal forming dies with thin, almost knife-edged contours would be required to form the ideal trunnion configuration of bearing support member 28. The configuration of bearing support member 70 results in longer tool life, better tool alignment, and more consistently dense metal of the finished part. The long arcuate bottom portion 80 and the smaller arcuate top portion 86 provide adequate support for the inner sleeves 42.

From the above, it will be apparent that the present invention provides a convenient subassembly consisting of a support member and bearings that can be economically manufactured and conveniently inserted laterally into a bore of a rocker arm. The subassembly does not require a machined and hardened support member or expensive drawn cup journaled roller bearings. The lateral insertion of the subassembly into the rocker arm eliminates manufacturing steps and reduces the overall cost of the rocker arm assembly.

Having described the invention, what is claimed is:

1. A rocker arm assembly comprising:

a bearing support member adapted for mounting on a support stud;

two annular bearings having a common axis, supported and retained on the bearing support member, the circumference of the bearings defining a cylindrical envelope perpendicular to the support stud and enclosing the bearing support member;

a rocker arm having a bore larger than the diameter of the cylindrical envelope and having an aperture for receiving the support stud, the bearings forming a clearance fit within the bore such that the rocker arm may be pivoted on the bearings about the axis of the bearing support member; and retaining means on the rocker arm engageable with the support stud for limiting movement of the rocker arm away from the support stud and for limiting axial movement of the rocker arm relative to the bearings.

2. The rocker arm assembly of claim 1, wherein the retaining means comprises surfaces on the rocker arm adjacent to the aperture of the rocker arm engageable with surfaces on the support stud.

3. The rocker arm assembly of claim 1, wherein the bore of the rocker arm is sufficiently large such that the bearing support member can be easily inserted into the bore and such that the bearings form a loose fit with the rocker arm.

4. The rocker arm assembly of claim 1, wherein the bearing support member has shoulders engaging the bearings and limiting movement of the bearings toward the support stud.

5. The rocker arm assembly of claim 1, wherein the bearings include an inner sleeve providing an inner race, an outer sleeve providing an outer race, and a plurality of rollers therebetween.

6. The rocker arm assembly of claim 5, wherein the inner sleeve is retained on the bearing support member by an interference fit.

7. The rocker arm assembly of claim 5, wherein the bearing support member has a noncylindrical surface over which the inner sleeves of the bearings are mounted.

8. The rocker arm assembly of claim 7, wherein the noncylindrical surface of the bearing support member, in cross-section, has a first arcuate portion extending less than 180 degrees and a smaller second arcuate portion of the same radius opposite the first arcuate portion and a second smaller arcuate portion opposite the first arcuate portion, both arcuate portions engaging the inner sleeve, the arcuate portions being separated by tool reliefs that do not engage the bearings.

9. The rocker arm assembly of claim 8, wherein the tool reliefs are symmetrical and are formed by angled portions angled at approximately 45 degrees from a plane of symmetry and by flat portions substantially perpendicular to the plane of symmetry.

10. A method of assembling a rocker arm assembly, the method comprising the steps of:

providing a bearing support member having a first bore to receive a support stud;

mounting bearings on the bearing support member, on a common axis perpendicular to the first bore and on opposite sides of the first bore, to provide a bearing subassembly;

providing a rocker arm having a second bore to accommodate the bearing subassembly and having an aperture to accommodate the support stud;

inserting the bearing subassembly axially into the second bore to a position in which the bearings form clearance fit with the rocker arm on opposite sides of the aperture of the rocker arm; and inserting the support stud through the aperture of the rocker arm and through the first bore such that movement of the bearing support member and rocker arm away from the support stud is limited by engagement of the rocker arm with the support stud.

11. The method of assembling the rocker arm assembly of claim 10, wherein the step of mounting bearings on the bearing support member includes rigidly mounting an inner sleeve on the bearing support member, the inner sleeve providing an inner race surface for rollers and limiting movement of the rollers axially relative to the axis of the bearings.

12. The method of assembling the rocker arm assembly of claim 11, wherein the step of mounting bearings on the bearing support member includes staking.

13. The method of assembling the rocker arm assembly of claim 11, wherein the bearing support member is made of powdered metal.

14. The method of assembling the rocker arm assembly of claim 10, wherein the bearing support member is made of powdered metal formed by dies moved in the direction of the axis of the first bore.

15. A rocker arm bearing assembly for use with a rocker arm having a first bore, the bearing assembly comprising:

a bearing support member having a second bore;

two annular inner sleeves having a common axis and being rigidly mounted on the bearing support member, each of the inner sleeves having a radially outwardly extending first flange;

two annular outer sleeves coaxial to and radially outward of the inner sleeves, each of the outer sleeves having a radially inwardly extending second flange engageable with the bearing support member such that movement of the outer sleeve toward the second bore is restricted, the circumference of the outer sleeve defining a cylindrical envelope perpendicular to the second bore and enclosing the support member, the cylindrical envelope having a diameter smaller than the first bore such that a clearance fit is provided; and a plurality of rollers within the annulus between each inner sleeve and between the first and second flanges, the rollers being retained in the direction of the axis of the sleeves by the first and second flanges.

* * * * *